US009908666B2

(12) United States Patent
Walsh et al.

(10) Patent No.: US 9,908,666 B2
(45) Date of Patent: Mar. 6, 2018

(54) BOTTLE NECK INSERT FOR INHIBITING SPILLAGE OR ACCIDENTAL EXPOSURE, AND RELATED METHODS AND SYSTEMS

(71) Applicant: Purebacco USA LLC, Boyne City, MI (US)

(72) Inventors: Mark D. Walsh, Boyne City, MI (US); Bruce C. Nemec, Kalispell, MT (US); Jason R. Rohr, Palmyra, WI (US)

(73) Assignee: Purebacco USA LLC, Boyne City, MI (US)

( * ) Notice: Subject to any disclaimer, the term of this patent is extended or adjusted under 35 U.S.C. 154(b) by 0 days.

(21) Appl. No.: 15/261,569

(22) Filed: Sep. 9, 2016

(65) Prior Publication Data

US 2017/0066564 A1 Mar. 9, 2017

Related U.S. Application Data

(60) Provisional application No. 62/216,220, filed on Sep. 9, 2015.

(51) Int. Cl.
*B65D 39/08* (2006.01)
*B65D 1/02* (2006.01)
(Continued)

(52) U.S. Cl.
CPC ..... *B65D 39/08* (2013.01); *B65D 1/0246* (2013.01); *B65D 39/04* (2013.01); *B65D 51/002* (2013.01);
(Continued)

(58) Field of Classification Search
CPC .... B65D 39/08; B65D 39/04; B65D 47/2031; B65D 1/0246; B65D 1/023; B65D 51/002;
(Continued)

(56) References Cited

U.S. PATENT DOCUMENTS 2,911,123 A * 11/1959 Geno ..... A61M 5/162 215/247
3,334,779 A * 8/1967 Smith ..... B60K 15/04 220/229
(Continued)

FOREIGN PATENT DOCUMENTS

DE 2355511 A1 * 5/1975 ..... B01L 3/50825
DE 90 06 079 U1 9/1990
(Continued)

OTHER PUBLICATIONS

International Search Report dated Nov. 3, 2016 in International Patent Application No. PCT/US2016/051137.
(Continued)

*Primary Examiner* — Robert J Hicks
(74) *Attorney, Agent, or Firm* — Venable LLP; Steven J. Schwarz

(57) ABSTRACT

A bottle neck insert can include a cylindrical body having a first end and a second end, the cylindrical body having a plurality of rings; a flange provided at the first end, the flange protruding outwardly from the cylindrical body in a radial direction of the cylindrical body; and a valve section at the second end, the valve section having at least one slit, wherein the flange is configured to seat the insert onto a neck of a bottle and the valve section is configured to allow a pipette to pass through. A bottle storage system, can include a bottle having a neck with a smooth interior surface; an insert that is configured to fit inside the neck of the bottle; and a pipette assembly that is configured to proceed through the insert into the bottle.

16 Claims, 15 Drawing Sheets

(51) Int. Cl.

| | |
|---|---|
| ***B65D 39/04*** | (2006.01) |
| ***B65D 53/00*** | (2006.01) |
| ***B65D 51/00*** | (2006.01) |
| *B01L 3/00* | (2006.01) |

(52) U.S. Cl.
CPC ..... *B65D 53/00* (2013.01); *B01L 3/50825* (2013.01); *B01L 2300/044* (2013.01); *B01L 2300/049* (2013.01)

(58) Field of Classification Search
CPC ..... B65D 51/1644; B65D 51/1683; B65D 53/00; B01L 3/50825; A47G 19/2272; A47G 19/2266; A47G 19/2222
USPC ..... 220/229, 528, 203.11, 203.13, 709, 705, 220/367.1, 804, 803, 802, 801; 215/229, 215/228, 355, 260, 311, 307, 388, 387, 215/364; 277/645, 644, 628
See application file for complete search history.

(56) References Cited

U.S. PATENT DOCUMENTS

| | | | | |
|---|---|---|---|---|
| 3,881,624 | A | 5/1975 | Dougherty, Sr. | |
| 4,286,633 | A | 9/1981 | Herr | |
| 4,383,618 | A | 5/1983 | Dougherty | |
| 4,478,342 | A | 10/1984 | Slater et al. | |
| 4,768,682 | A | 9/1988 | Friedrich | |
| 4,886,175 | A | 12/1989 | Schlaudecker | |
| 4,895,282 | A | 1/1990 | Robinson | |
| 5,232,109 | A * | 8/1993 | Tirrell | B01L 3/50825 215/247 |
| 5,246,145 | A | 9/1993 | Leoncavallo et al. | |
| 6,045,003 | A | 4/2000 | Seidler | |
| 6,054,099 | A | 4/2000 | Levy | |
| 6,435,341 | B1 | 8/2002 | Nobbio | |
| 6,681,945 | B1 | 1/2004 | Harrold | |
| 6,716,396 | B1 | 4/2004 | Anderson et al. | |
| H2101 | H | 5/2004 | Faughey et al. | |
| 7,017,782 | B2 | 3/2006 | Harrold | |
| 8,034,272 | B2 | 10/2011 | Pavlovic et al. | |
| 8,333,288 | B2 | 12/2012 | Miller et al. | |
| 8,387,810 | B2 | 3/2013 | Livingston et al. | |
| 8,444,610 | B2 | 5/2013 | Grevin | |
| 8,621,944 | B2 | 1/2014 | Stein | |
| 8,690,019 | B2 | 4/2014 | Defemme et al. | |
| 2004/0052688 | A1 | 3/2004 | Adema et al. | |
| 2009/0139953 | A1 | 6/2009 | Py | |
| 2011/0130740 | A1 | 6/2011 | Levy | |
| 2012/0225766 | A1 * | 9/2012 | Seubert | B01D 21/262 494/37 |
| 2014/0011292 | A1 | 1/2014 | Lentz et al. | |

FOREIGN PATENT DOCUMENTS

| | | | | |
|---|---|---|---|---|
| EP | 1 997 558 | A1 | 12/2008 | |
| FR | 2348114 | A1 * | 11/1977 | B65D 39/0023 |
| FR | 2 772 727 | A1 | 6/1999 | |
| WO | WO-1996041750 | A1 | 12/1996 | |

OTHER PUBLICATIONS

Written Opinion dated Nov. 3, 2016 in International Patent Application No. PCT/US2016/051137.

* cited by examiner

SECTION A-A

BOTTLE NECK INSERT FOR INHIBITING SPILLAGE OR ACCIDENTAL EXPOSURE, AND RELATED METHODS AND SYSTEMS

CROSS-REFERENCE TO RELATED APPLICATIONS

This application claims priority to U.S. Provisional Application No. 62/216,220, filed Sep. 9, 2015, the content of which is hereby incorporated herein in its entirety.

TECHNICAL FIELD

The present invention relates to devices, systems and methods for inhibiting spillage or accidental exposure of the contents of bottles and packaging.

BACKGROUND

Traditional "Boston Round" glass bottles having smooth interior surfaces in the neck region with removable child-proof droppers have no mechanism to prevent spillage or drinking once the dropper is removed. These bottles often contain concentrated essential oils, or e-liquids (nicotine liquids) which require child safe packaging; however, even with approved industry leading child safety safeguards in place, once the dropper is removed, there is no existing mechanism which serves the purpose of a physical barrier for limiting spillage or accidental exposure.

Further, bottles having interior surfaces that are not smooth, for example having protruding and recessing threads, have no mechanism to prevent spillage or drinking once the dropper is removed.

There are no known commercially available solutions, which solve these problems. Until now, people simply attempted to physically avoid spillage. What is needed are systems, devices and methods for inhibiting spillage or accidental exposure of the contents of bottles and packaging.

SUMMARY OF THE INVENTION

A bottle neck insert can include a cylindrical body having a first end and a second end, the cylindrical body having a plurality of rings; a flange provided at the first end, the flange protruding outwardly from the cylindrical body in a radial direction of the cylindrical body; and a valve section at the second end, the valve section having at least one slit, wherein the flange is configured to seat the insert onto a neck of a bottle and the valve section is configured to allow a pipette to pass through.

A bottle storage system, can include a bottle having a neck with a smooth interior surface; an insert that is configured to fit inside the neck of the bottle; and a pipette assembly that is configured to proceed through the insert into the bottle.

Additional features, advantages, and embodiments of the invention are set forth or apparent from consideration of the following detailed description, drawings and claims. Moreover, it is to be understood that both the foregoing summary of the invention and the following detailed description are examples and intended to provide further explanation without limiting the scope of the invention as claimed.

DETAILED DESCRIPTION

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections, are incorporated by reference as if each had been individually incorporated.

Some embodiments of the invention relate to a "Dropper Bottle Neck Insert Spill Inhibitor," or insert, which can be a pinch valve inserted into the neck of the bottle. Some embodiments allow a dropper tip to pass easily in and out of the pinch valve with the pinch valve sealing the bottle against leakage or spillage once the dropper is removed.

Some embodiments of the insert may be produced from an assortment of materials including: Neoprene, HDPE (High-density polyethylene), LDPE (Low-density polyethylene), PET (Polyethylene terephthalate), and Silicone of differing grades. For example, medical grade silicone can be used for its low chemical reactivity profiles, but the inhibitor design is suitable for an array of different materials including a variety of plastics, rubbers, and silicones which may be used for different chemical reactivity scenarios. Some embodiments may comprise a single continuous piece of material injection molded using cavity die molding processes incorporating a single or multi-cavity die.

Figure 1:
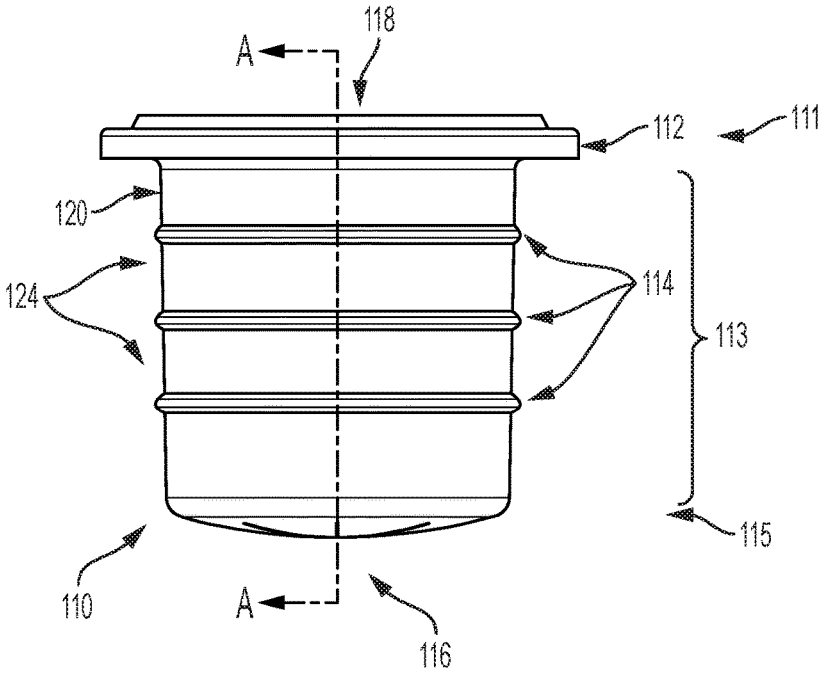
FIG. 1 shows a front view of a dropper bottle neck insert spill inhibitor, according to an embodiment of the invention.

As shown in FIG. 1, the insert 110 can be seen in its entirety from a side view. The insert 110 can comprise a single piece of molded material marked by five distinct areas of the insert. The top section 111 can comprise the pipette passage vacancy which allows the pipette to pass through the insert freely (through line "A").

Bottle neck seating collar flange 112 can surround the top section 111 of the insert 110, which can allow the insert 110 to rest on a lip of a bottle neck without sliding down into the bottle. In some embodiments, thin wall retention "upper lip" allows for deployment into existing systems with a tolerance for inclusion in a range of 0.4 to 0.7 mm. In an embodiment, the tolerance for inclusion is 0.4 mm.

A middle section 113 of the inhibitor can include a neck barrel mating section or cylindrical body 120, which comprises a barreled tube that is configured to be mated to an inside neck of a bottle. The collar flange 112 can protrude outwardly from the neck barrel mating section 120 in a radial direction of the neck barrel mating section 120. Along the neck barrel mating section 120, three elevated friction seal rings 114 can be provided, each of which can circumscribe the neck barrel mating section 120. Alternatively, more or less than three friction seal rings 114 can be provided. The cylindrical body 120 can have an outer diameter of about 12 mm. The inner diameter of the cylindrical body 120 can be about 10.5 mm.

Figure 2:
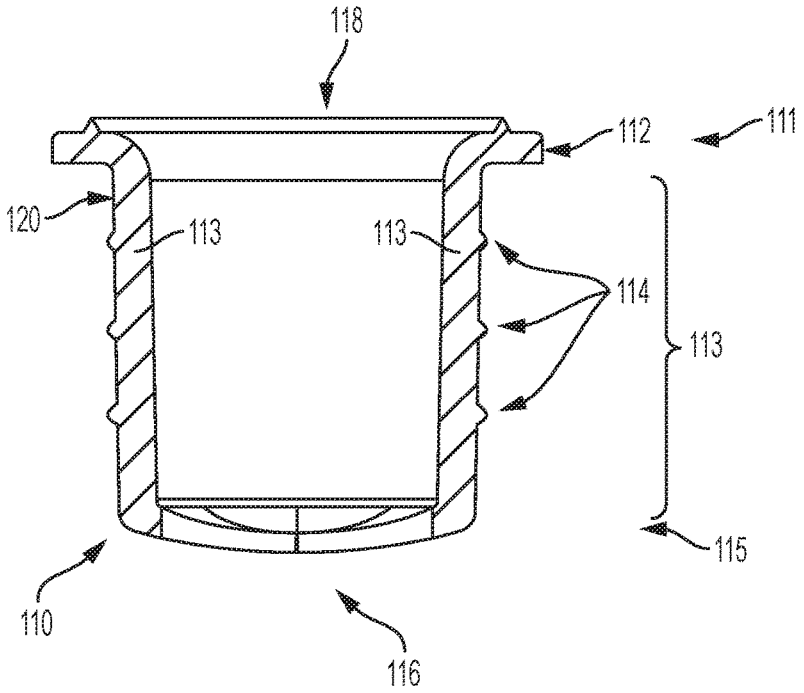
FIG. 2 shows a cross-section view of FIG. 1.

Many embodiments were attempted to create a friction fit effect, but in many scenarios, the pressure on the ends forced the pinch valve to stay open ("resting state open"). This resulted in the specific shape and distribution of the friction fit rings to allow pressure distribution and normalization at the ends. Referring to FIG. 2, the insert 110 can use a system of the three rings 114 evenly spaced along the body of neck barrel mating section 120 to effectively divide the Neck Barrel Mating Section 120 into four even sections. These four sections can be necessary for the friction fit to function effectively and consistently because they can concentrate and diffuse pressure along the neck barrel mating section 120, allowing for the pressure to be re-normalized at both ends of the tube. This can allow the pinch valve and open end of the insert 110 to function at nominal pressure loads by concentrating the friction fit pressures into the two middlemost sections of the neck barrel mating section 120 and allowing the pressure at both ends to be released. Due to this feature, accidental activation (opening) can be avoided while in the resting state.

The system of friction rings can also be designed to prevent lubricating solvents from compromising the seal. By using three rings 114, the entrance of solvents and lubricants into the middle sections of the neck barrel mating section 120 can be prevented and/or minimized and greater dry adhesion factors can be afforded. The rings 114 both provide friction adhesion as well as sealing off the friction adhesion area. Transverse rings added the requisite sealing properties necessary to make the inhibitor universal.

Additionally, this three ring system can create two vacuum cavities which the insertion of the pipette activates. That is, insertion of the pipette forces moisture out of the cavities and creates a secondary adhesion due to the capillary action of the fluid medium. In this way, the three ring system can create mechanical friction as well as a practical vacuum to increase adhesion. The plurality of seal rings 114 can be configured to generate negative pressure against a smooth surface of a neck of the bottle to lock the insert 110 into a position during normal use. The plurality of seal rings can be configured to generate negative pressure against an interior smooth surface of a neck of a Boston round bottle. Normal use of the bottle can include, for example, using a pipette assembly for liquid extraction.

Each of the friction seal rings 114 can protrude identically, although they can be very small and can approach limits of the material medium. Because of the limits of the material medium, some variation in application is expected and tolerable. That is, although silicone is a highly precise material for injection, this is a supple and pliable unit, and the rings themselves are in a range of 0.1 mm and 0.2 mm, with natural variation occurring within that range (normal for silicone molding). This means that as designed, the friction seal rings can be identically shaped and sized, but in practical application they may vary by as much as double due to imprecision of cavitation and mold adherence.

A "Lubricant Saturated" testing model was used and embodiments of the invention were designed accordingly. The math for optimizing friction seal ring coefficients can become more complex when lubricant is applied. The insert friction seal can fit and function while saturated with lubricant. The three ring design created the dual adhesion properties, which allows the design to function.

Figure 3B:
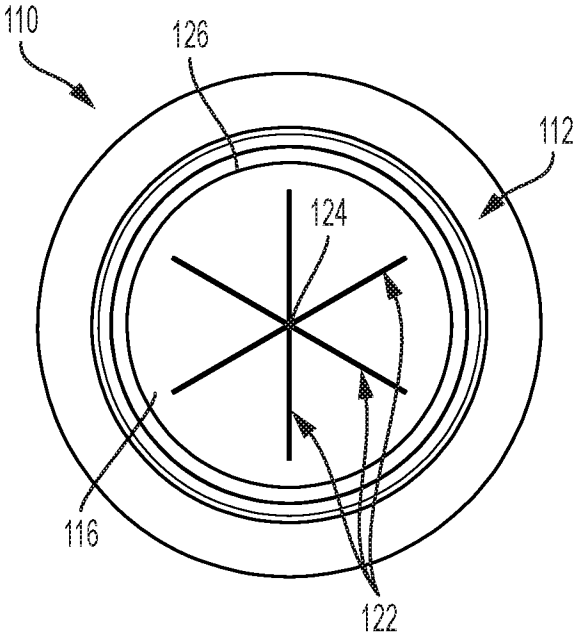
FIG. 3B shows a top view of FIG. 1.

Referring to FIG. 1, at a bottom section 115 of the insert 110, the neck barrel mating section 120 can resolve and terminate into pinch valve segment 116 where a pinch valve itself, as seen in FIG. 3B, resides. These five parts of the insert 110 can all be continuous and molded from a single piece of material. Thus, an embodiment of the invention can be a bottle interfacing inhibitor comprising a cylindrical body having a first 111 and a second portion 115. The cylindrical body 120 can have a plurality of seal rings 114. The bottle interfacing insert 110 can further comprise a flange 112 provided at the first portion 111. The flange can protrude outwardly from the cylindrical body in a radial axis of the cylindrical body. The flange 112 can be in a range of about 2.5 mm to 3.5 mm. In an embodiment, the flange is in a range of about 3.0 mm to 3.2 mm. The bottle interfacing insert 110 can comprise a valve section 116 at the second end 115. The valve section can have at least one slit 122. The flange 112 can be configured to seat the insert 110 onto a neck of a bottle and the valve section can be configured to allow a pipette to pass through. The cylindrical body 120, the flange 112 and the valve section 116 can be a single piece of continuous material that is composed of silicone As shown in FIG. 2, a sectional view of the insert 110 can be seen. The insert 110 can comprise a single piece of molded material marked by five distinct areas of the insert. The top section 111 can include the pipette passage vacancy 118, which allows a pipette to pass through the inhibitor freely. Surrounding the top section 111, the bottle neck seating collar flange 112 can allow the insert 110 to rest on the lip of the bottle neck without sliding down into the bottle.

The middle section 113 of the inhibitor can comprise neck barrel mating section 120, which can be a barreled tube that is configured to be mated to the inside neck of the bottle. The middle section 113 can be shaped to proceed straight down to afford maximum wall-to-wall surface adhesion and increase its universality. In embodiments where the tapering design was experimented with, the requisite co-efficient of friction could not be achieved to provide a stable deployment. In other words, we had to make the walls as straight as possible in order to maximize the surface area in contact with the inside neck of the bottles. All other designs required secondary locking mechanisms. Additionally, the length of the insert can be maximized to provide greater surface to surface contact. Three elevated friction seal rings 114 can be provided along, and can circumscribe, the neck barrel mating section 120.

The thickness of the middle section walls 113 can be the same towards the top near the collar 112 as the bottom towards the pinch valve segment 116. In some embodiments, a number of different thickness were tried to resolve the resting state issues. In the end, it was found that to normalize the pressure at the ends it was necessary in some embodiments to provide a continuous thickness along the entire length of neck barrel mating section 120. Additionally, this thin wall design affords a greater tilt-ability of the pipette allowing the user to tilt and angle the pipette freely into the body of the bottle. The variable wall thickness designs did not allow for this effect.

At a lower section 115 of the insert 110, the neck barrel mating section 120 can resolve and terminate into pinch valve segment 116 where the pinch valve itself resides. These five parts of the insert can all be continuous and molded from a single piece of material, as seen in FIG. 2.

Figure 3A:
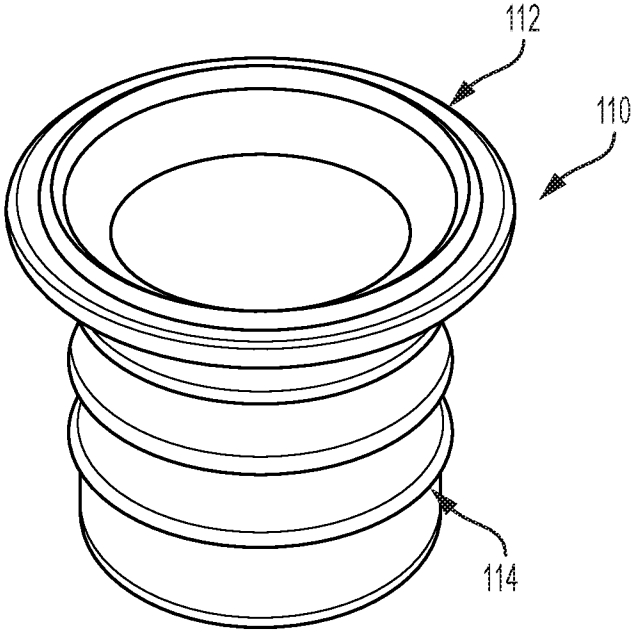
FIG. 3A shows a perspective view of FIG. 1.

FIG. 3A shows a perspective view of the insert 110. In a top section 111 of the insert 110, bottle neck seating collar flange 112 can comprise the bottle neck seating flange which seats the insert 110 onto the neck 103 of the bottle 102 and prevents it from slipping down into the bottle 102.

FIG. 3B shows a top view of the insert 110. The top view of the insert 110 shows pinch valve slits 122 viewed from the top down.

At a bottom portion 115 of the insert 110, the valve section 116 of the insert can comprise pinch valve slits 122. In an embodiment of the invention, the valve section 116 can include six radial slits 122 which open to allow the pipette to pass through. The valve slits 122 can close once the pipette is removed to thus seal the bottle against any accidental spillage. A number of slit configurations are possible. In an embodiment, six slits can be spaced once every 60 degrees. These slits can run 85% to 99% of the length from the center 124 to the edge 126 of the valve section 116 depending on the exact configuration of both the neck's inside diameter and the pipette's outside diameter. For example, the ratio of pipette outside diameter to bottle neck inside diameter can determine the calibration for a specific length of these slits. In a Universal Embodiment, the slits can be effective at 98% of the width of the insert, accommodating most commercially available common sizes.

In an embodiment, the slits can include three slits which are evenly spaced and bisected at the center creating the illusion of six slits. The "six slit" model allowed for the resting state open problem to be further resolved because the slits have the ability to overlap. In some embodiments, four and eight slit designs are viable under certain circumstances, for example, depending on material selection.

In the middle section 113, elevated friction seal rings 114 can seal the insert 110 into the neck of the bottle and prevent it from slipping in or out of the neck of the bottle while the pipette is removed or inserted.

Figure 4D:
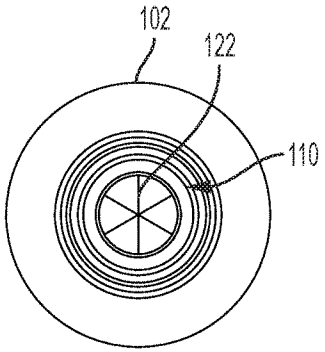
FIG. 4D shows a top view of FIG. 4A.
Figure 4C:
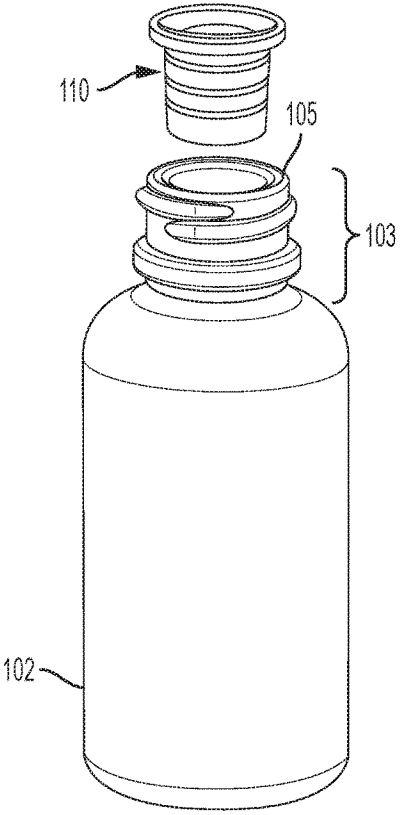
FIG. 4C shows an exploded, perspective view of a dropper bottle neck insert spill inhibitor with bottle, according to an embodiment of the invention.
Figure 4B:
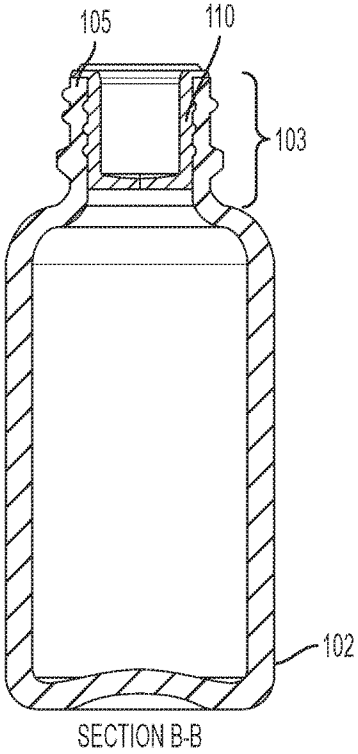
FIG. 4B shows a cross-section view of FIG. 4A.
Figure 4A:
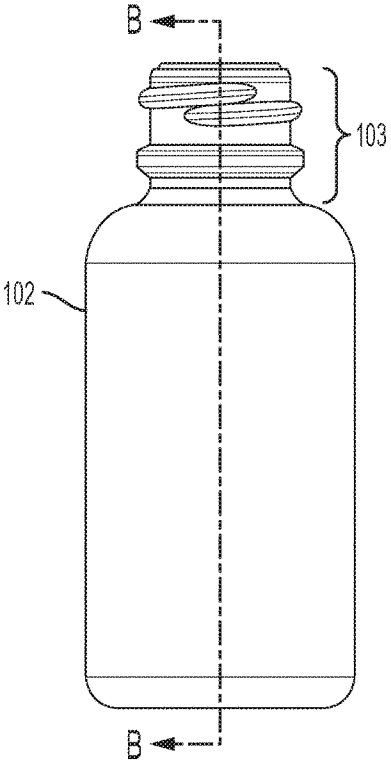
FIG. 4A shows a front view of a dropper bottle neck insert spill inhibitor with bottle, according to an embodiment of the invention.
Figure 5D:
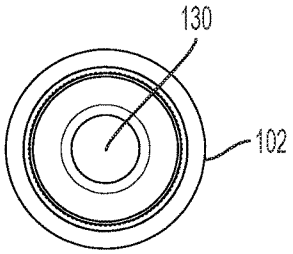
FIG. 5D shows a top view of FIG. 5A.
Figure 5C:
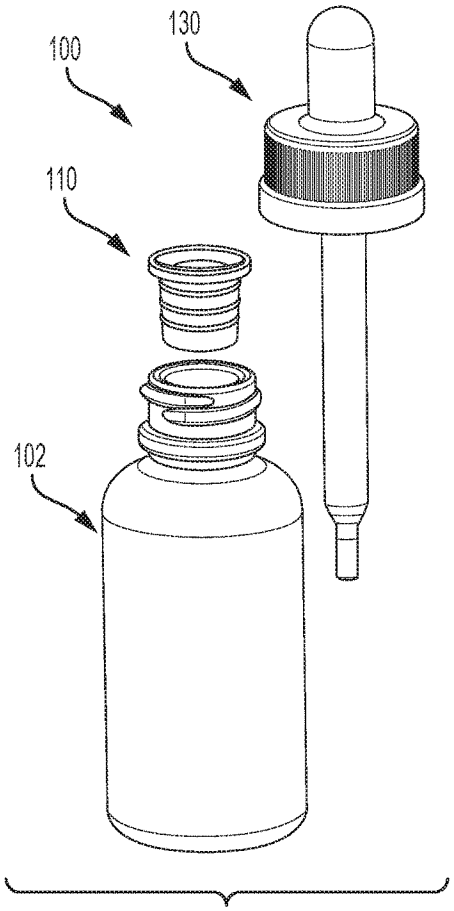
FIG. 5C shows an exploded, perspective view of a dropper bottle neck insert spill inhibitor with bottle and pipette, according to an embodiment of the invention.
Figure 5B:
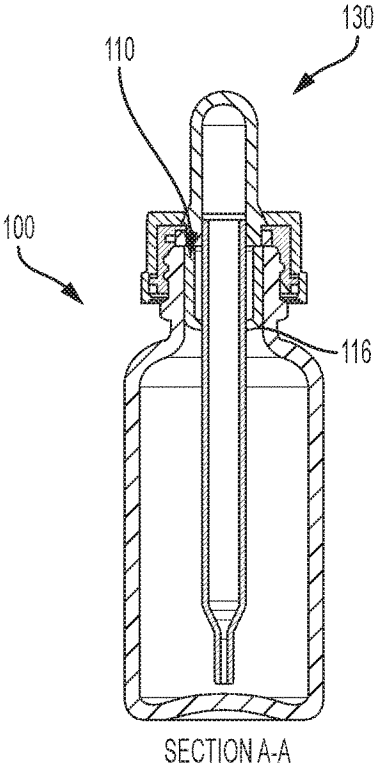
FIG. 5B shows a cross-section view of FIG. 5A.
Figure 5A:
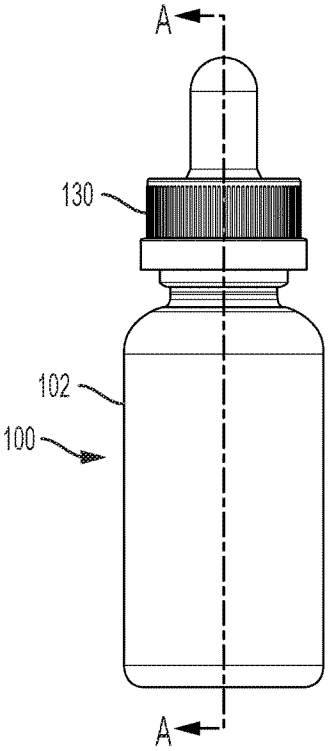
FIG. 5A shows a front view of a dropper bottle neck insert spill inhibitor with bottle and pipette, according to an embodiment of the invention.

As shown in FIGS. 4A-4D, the insert 110 can be seen in context with the bottle 102 both outside the neck 103, and in position inserted into the neck of the bottle. As seen in FIG. 4C, the insert or inhibitor 110 shown above the bottle neck shows how the insert 110 relates to the bottle 102 itself prior to seating into the neck 103. As seen in FIG. 4B, the insert 110 can rest on upper portion 105 of neck 103. In FIG. 4B, the insert 110 is shown in the inserted position inserted into the neck 103 of the bottle 102 as it would be seated during actual usage.

As shown in FIGS. 5A-5D, the insert 110 can be seen in context with both the bottle 102 and the pipette assembly 130 both outside the neck, and in position inserted into the bottle 102 with the pipette 130 passing through the pinch valve 116.

A pipette assembly 130 shows the standard squeeze bulb dropper pipetting system. A relationship between the bottle 102, the insert 110, and the pipette assembly 130 can be seen in FIG. 5A-5D through spill insert 110, pipetting system dropper 130 and glass bottle 102. Glass bottle 102 can be a standard commercially available "Boston Round" dropper bottle. Insert 110 can be seen inserted with pipette 130 in position illustrating how all three objects come together to complete the system 100.

Figure 6:
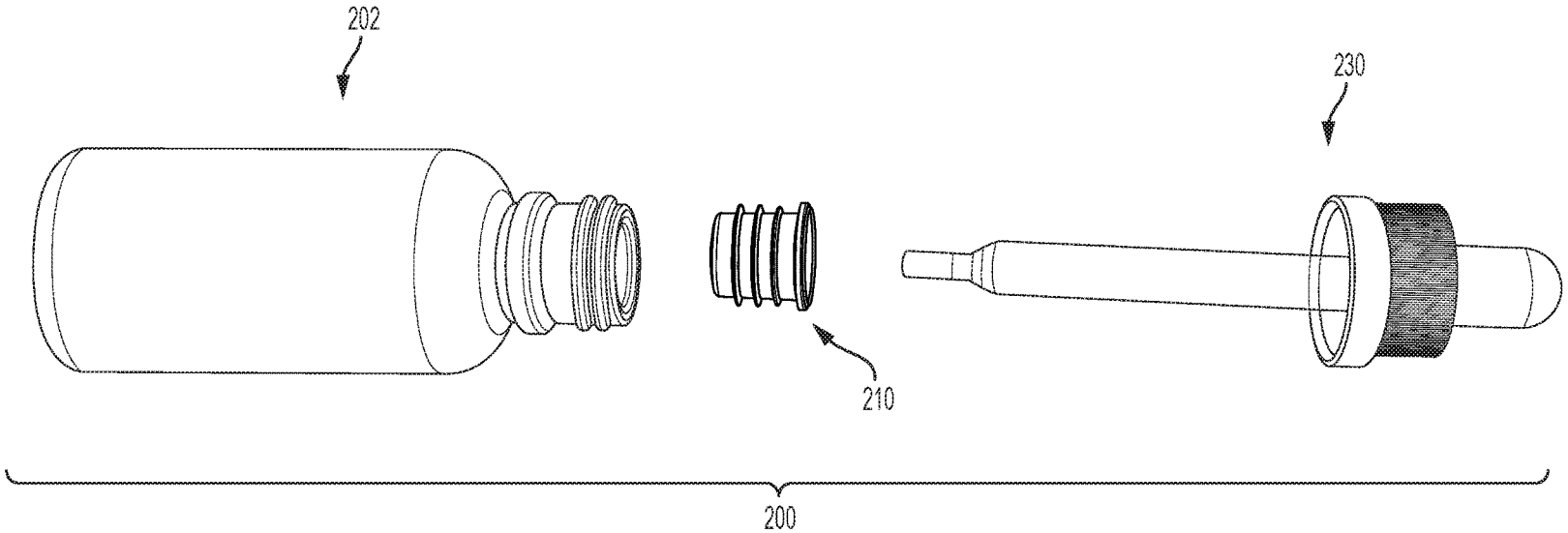
FIG. 6 shows an exploded view of a bottle, dropper bottle neck insert and pipette, according to an embodiment of the invention.

As shown in FIG. 6, the actual spill insert 210 can sit between the bottle 202 and the pipette assembly 230. Here the insert 210 can sit beside an actual bottle 202, and pipette 230, which all together shows how the spill inhibitor works in the system 200.

Figure 7:
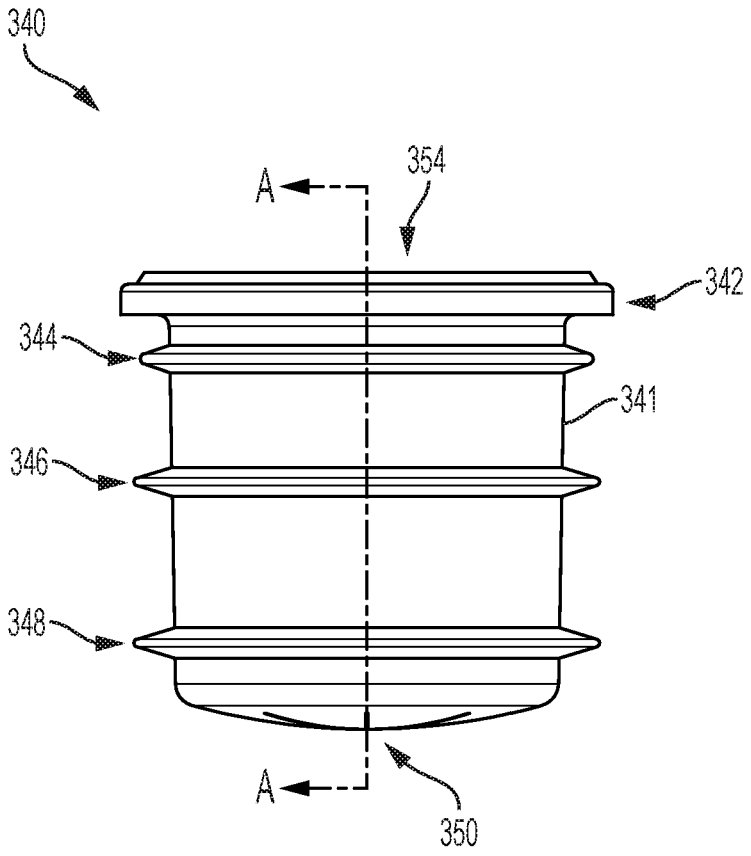
FIG. 7 shows a front view of an insert, according to another embodiment of the invention.

FIG. 7 shows a front/rear view of an insert according to other embodiments of the invention. According to embodiments, an insert 340 can be a locking spill inhibitor. The insert 340 can have the shape of a substantially cylindrical member. A top portion 343 of the insert 340 can include a bottle neck seating collar flange 342. The bottle neck seating collar flange 342 can protrude radially outwardly from a cylindrical shape of the insert 340. The bottle neck seating collar flange 342 and remainder of the cylindrical shape of the insert 340 can outline a pipette passage vacancy 354, where a pipette can fit inside.

As can be seen from FIG. 7, the insert 340 can include a cylinder housing 341 having a plurality of rings that include a mated collar-locking ring 344, a stability ring 346, and a thread stop sealing ring 348. Some embodiments can accommodate the insert for use with a Mated Lock Chime Detail added to a bottle neck. In this regard, the insert 340 can include a mated collar-locking ring 344, a stability ring 346, and a thread stop sealing ring 348. The cylindrical housing 341 can have an outer diameter of about 12 mm. The inner diameter of the cylindrical body 341 can be about 10.5 mm.

Figure 8:
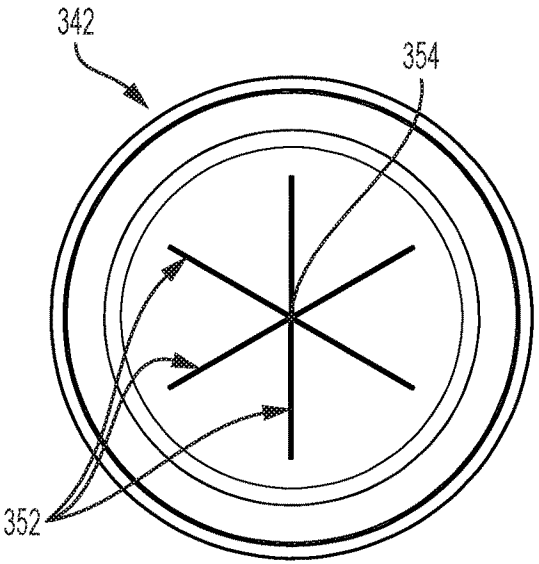
FIG. 8 shows a top view of FIG. 7.

FIG. 8 shows a top view of an insert according to an embodiment of FIG. 7. As can be seen, a bottom portion 345 at an opposing end of the top portion 343 can include pinch valve slits 352. The pinch valve slits 352 allow for a pipette to proceed through the insert 340 into an exterior area, i.e., such as a bottle. Similar to other embodiments, pinch valve slits 352 can be arranged to radially extend from a center point 356. In some embodiments, the pinch valve segment 350 can include six equiangular slits spaced at 60 degree angles from each other.

Figure 9:
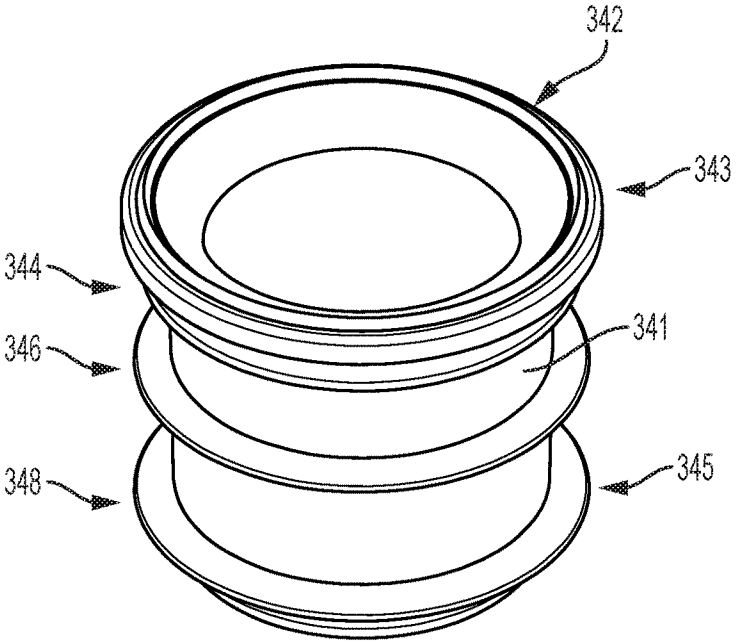
FIG. 9 shows a perspective view of FIG. 7.

FIG. 9 shows a perspective view of the insert of FIG. 7. As can be seen, the cylinder housing 341 can include a top portion 343 and a bottom portion 345.

Figure 10:
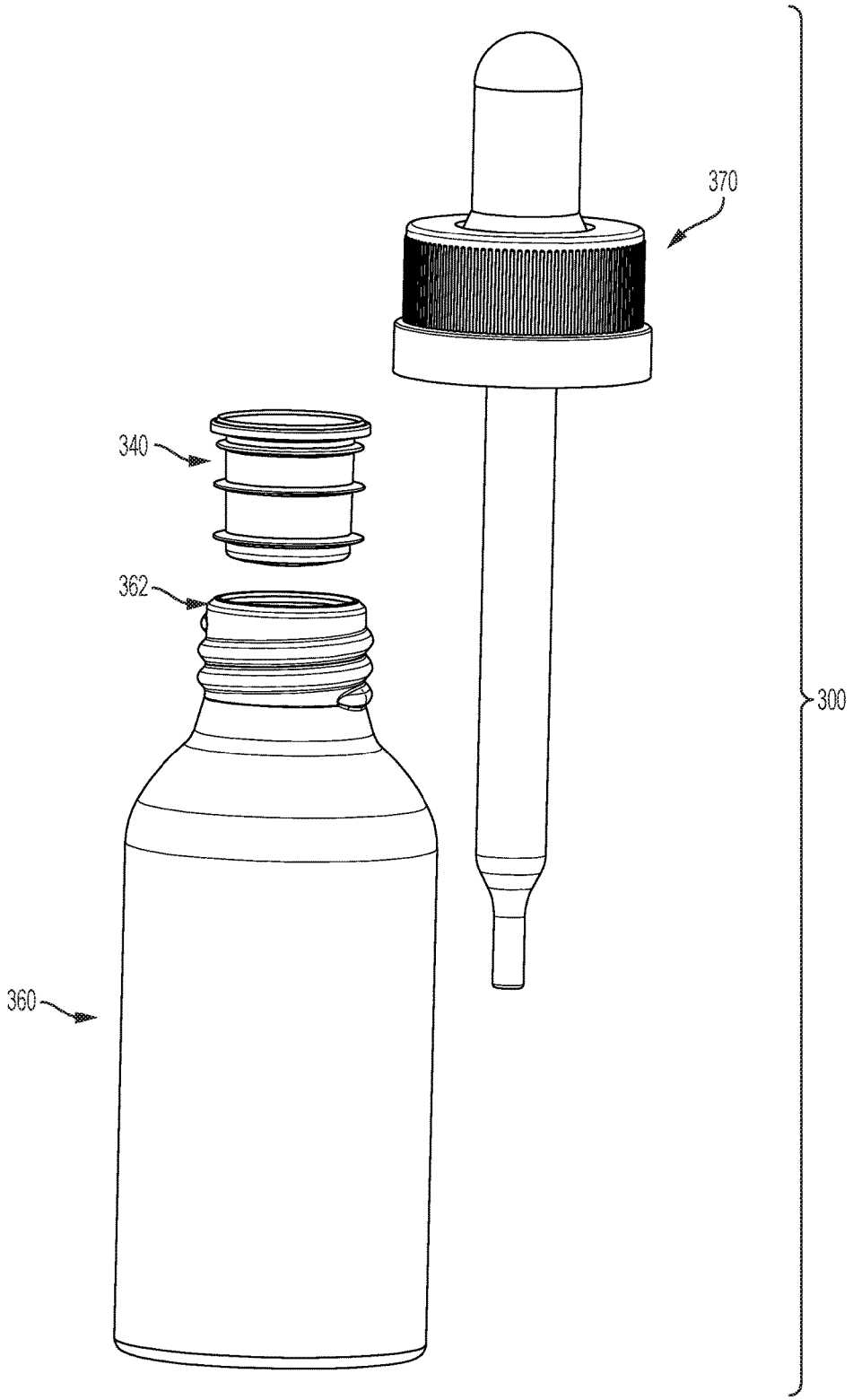
FIG. 10 shows an insert, a bottle and a pipette, according to an embodiment of the invention.

FIG. 10 shows a locking spill inhibitor insert 340 along with a bottle 360 having a bottle lock chime 362 and a pipette 370. As can be seen, the insert 340 can be configured to mate with the bottle 360, which can effectively form an elevated ridge at the top of the bottle. The bottle lock chime 362 can allow the insert 340 to function without a friction seal and instead rely on a force driven click lock system. The force driven click lock can make the insert 340 easy to insert, but difficult to remove as the center of mass passes the locking chime and holds the insert 340 in place.

Figure 12A:
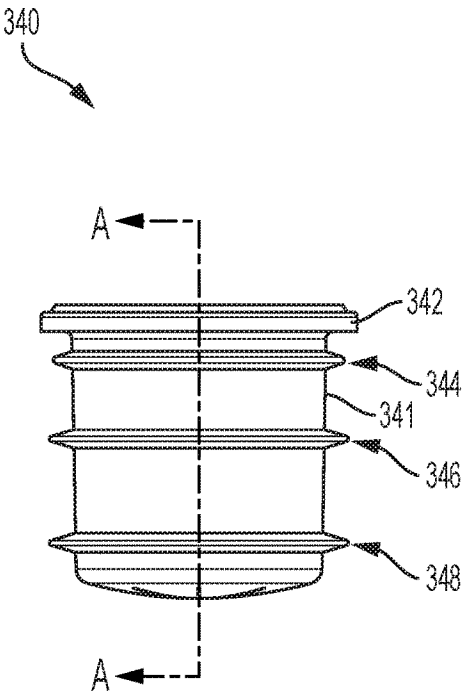
FIG. 12A shows a front view of an insert of a second embodiment of the invention.
Figure 11:
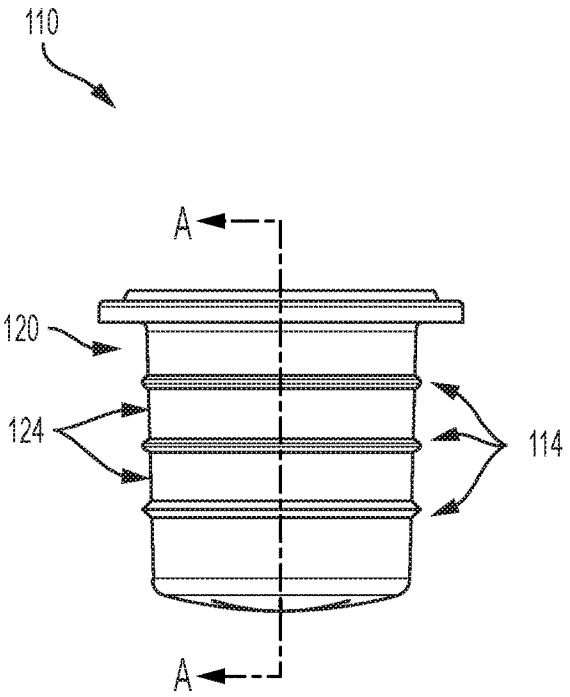
FIG. 11 shows a front view of an insert of an embodiment of the invention.

FIGS. 11 and 12A show the first and second embodiments, respectively, side-by-side. As can be seen, in FIG. 11 the Standard Spill Inhibitor Unit or insert 110 utilizes Elevated Friction Seal Rings 114 to create Micro-vacuum Channels 124, which can produce adhesion along the bottle neck wall preventing pull-out or push-in during normal operation. The two micro-vacuum channels create a negative pressure zone coupled to the friction effect of the Elevated Friction Seal Rings effectively lock the spill inhibitor in place during normal operation. Thus, the plurality of seal rings can outline at least one microchannel on an exterior surface of the cylindrical body where the negative pressure is configured to be generated.

FIG. 12A contrasts this with the second embodiment Locking Spill Inhibitor Unit 340 which utilizes Mated Collar-Locking Ring 344 which mates to Bottle Neck Locking Chime 362 to produce a Mated Locking effect with the flange located on the inside of the bottle neck. See FIG. 15A. The mated collar-locking ring 344 can be in a range of about 1 mm to about 3.5 mm. The subsequent flange, Stability Ring 346, is then used to stabilize the unit with the Thread Stop Sealing Ring 348 serving to further secure the unit in place at the bottom of the bottle neck.

Contrast Explained: Both embodiments include three elevated rings, however, in the second embodiment Locking Spill Inhibitor Unit 340 these rings are significantly larger and provide Physical Surface to Surface locks in the bottle neck, made possible by a ring added to the internal side of the bottle. The rings of the locking spill inhibitor unit 340 can extend up to 2 mm from the cylindrical housing 341. The rings of the locking spill inhibitor unit 340 can extend in a range of about 0.5 to about 3.0 mm. The rings of the locking spill inhibitor unit 340 can be in a range of 0.5 mm to 3 mm. The rings of the locking spill inhibitor unit 340 can be variant-dependent to accomplish the desired effect with a number of commercially available bottles of this thin wall design. By seamlessly terminating the collar flange 112 at the apex of the bottle neck top 362, a propensity for accidental removal effects caused by the hanging lip of 112 can be reduced. This effect can be customized for a number of commercially available bottle types. The locking can occur first at the top 343 of the thread cavity, and then again at the bottom 345. In contrast, the Standard Spill Inhibitor 110 can have the capacity to secure itself to an entirely smooth surface of a nonspecialized bottle and can do so with the use of friction as well as microvacuum cavities.

Figure 12B:
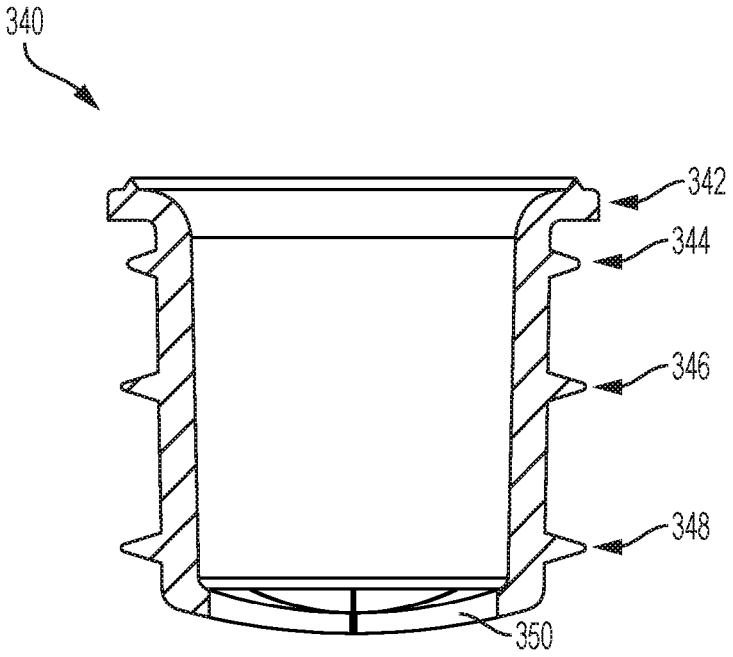
FIG. 12B shows a cross-section view of FIG. 12A.

FIG. 12B is a cross-section view of FIG. 12A. This embodiment can include a mated solution, although semi-universal in Embodiment 2 the Insert is mated to a specific bottle, and is thus variant dependent on the bottle it is being mated to. In this way, the rings and final length of the insert are variant within the confines of the embodiment. As long as the three rings are there, and they serve their three functions they can be individually variant based on the specific bottle they are mating to.

Figure 13D:
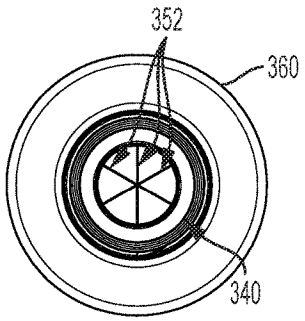
FIG. 13D shows a top view of FIG. 13A.
Figure 13C:
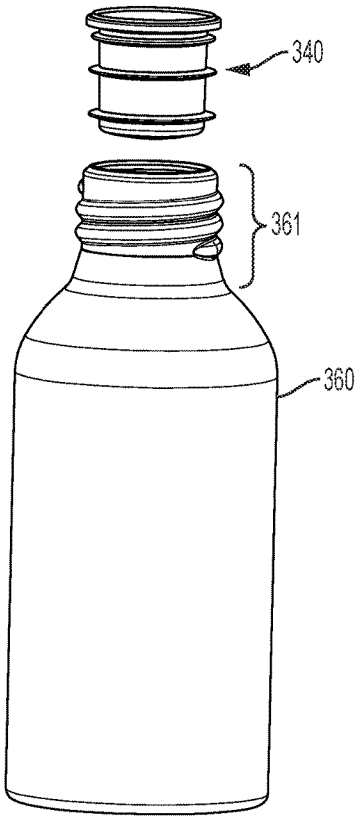
FIG. 13C shows an exploded perspective view of FIG. 13A.
Figure 13B:
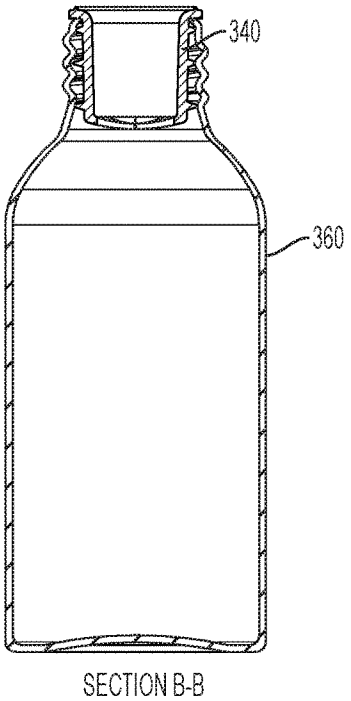
FIG. 13B shows a cross-section view of FIG. 13A.
Figure 13A:
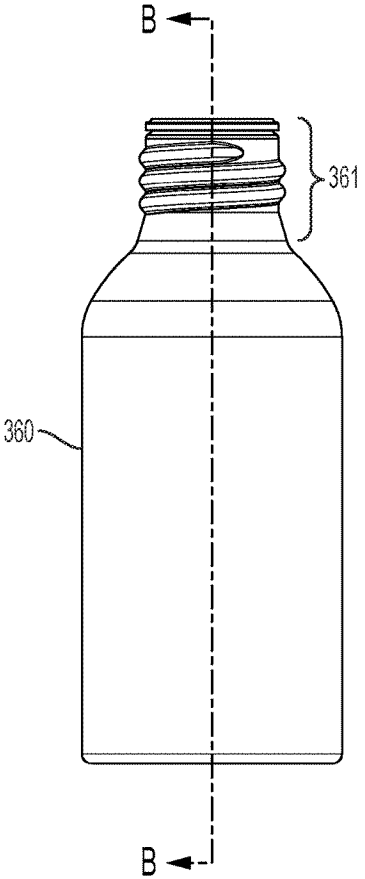
FIG. 13A shows a front view of a bottle having an insert in the neck, according to an embodiment of the invention.

FIG. 13A shows a front/rear view of a bottle with insert in the neck, according to an embodiment of the invention.

FIG. 13B shows a cross-section view of FIG. 13A.

FIG. 13C shows an exploded perspective view of FIG. 13A.

FIG. 13D shows a top view of FIG. 13A.

Figure 14D:
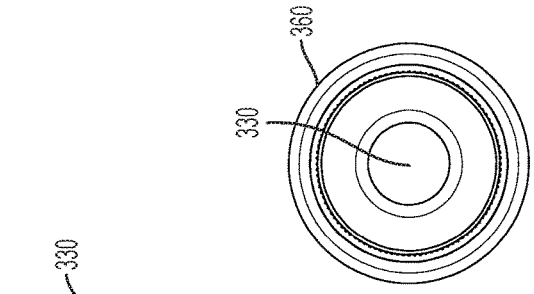
FIG. 14D shows a top view of FIG. 14A.
Figure 14C:
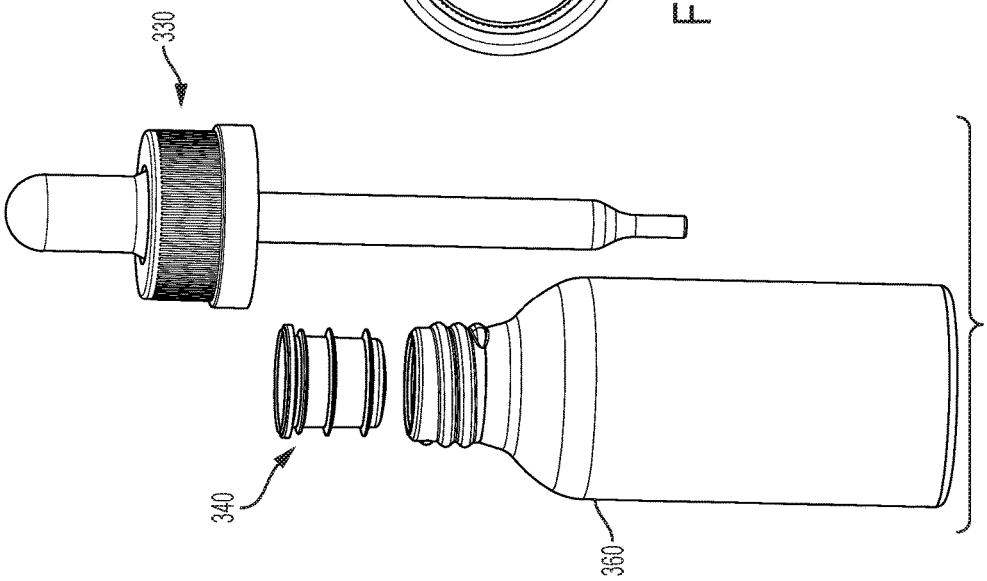
FIG. 14C shows an exploded, perspective view of FIG. 14A.
Figure 14B:
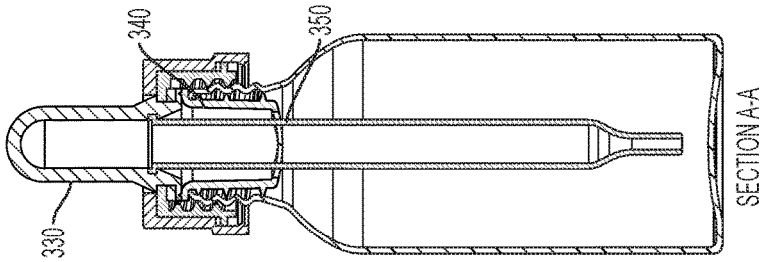
FIG. 14B shows a cross-section view of FIG. 14A.
Figure 14A:
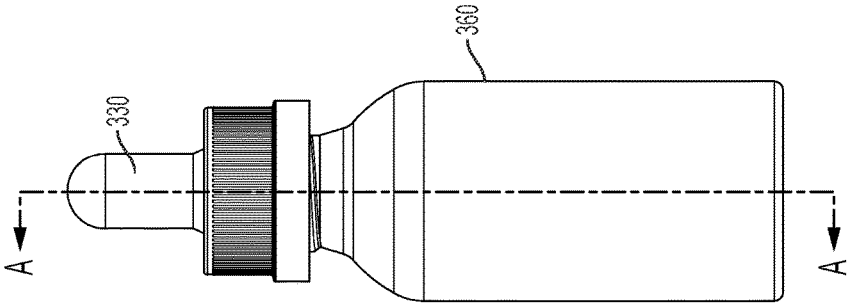
FIG. 14A shows a front view of a bottle having an insert in the neck and a pipette inserted therein, according to an embodiment of the invention.

FIG. 14A shows a front view of a bottle having an insert in the neck and a pipette 330 inserted therein, according to an embodiment of the invention.

FIG. 14B shows a cross-section view of FIG. 14A.

FIG. 14C shows an exploded, perspective view of FIG. 14A.

FIG. 14D shows a top view of FIG. 14A.

Figure 15B:
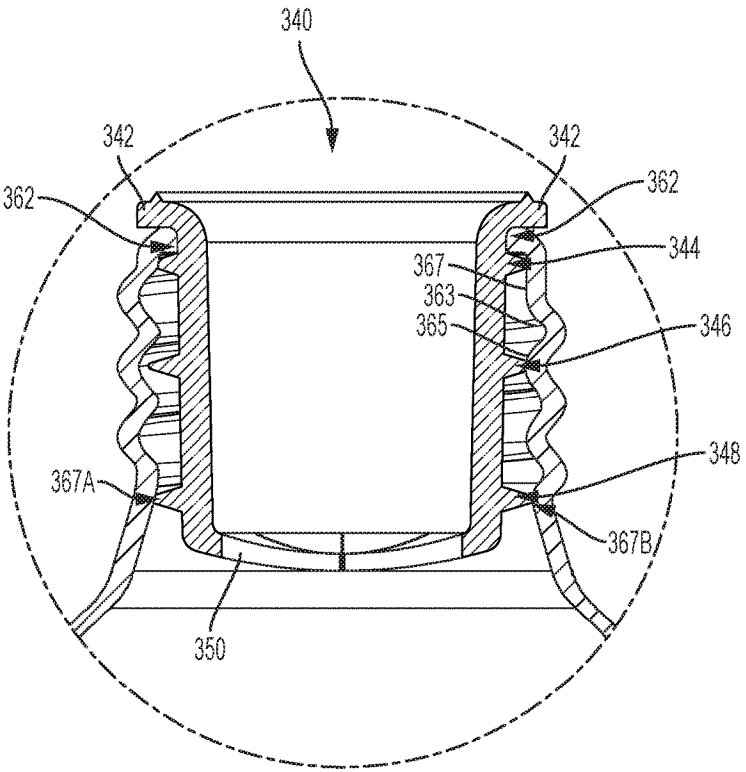
FIG. 15B shows a close-up view of FIG. 15A.
Figure 15A:
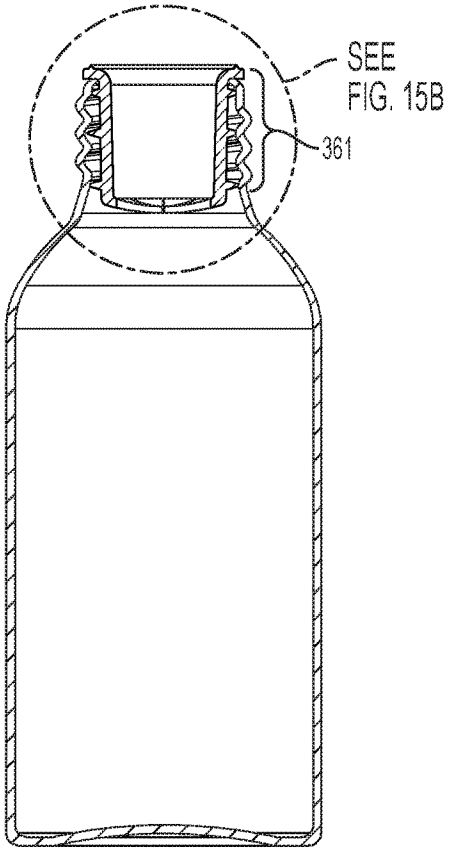
FIG. 15A shows a cross-section view of a bottle having an insert, according to an embodiment of the invention.

FIG. 15A shows a cross-section view of a bottle having an insert, according to an embodiment of the invention.

FIG. 15B shows a close-up view of FIG. 15A. As can be seen from FIG. 15B, the interior surface 367 of neck 361 can include a spiral-shaped recess 363 and protrusion 365 that winds from a bottom to the top of the neck 361. With such a neck interface 361, the thread stop sealing ring 348 can seal opposing ends of the neck 361 at points 367*a*, 367*b*. Stability ring 346 can interface with one or more protrusions 365 for increased stability of the insert 340 inside the neck 361.

FIGS. 15A and 15B show a detail of the second embodiment which clarifies the Bottle Neck Locking Chime 362. This bottle neck is a thin wall aluminum commercially available bottle where-in (as detailed) the threads themselves are reflected on both the inside and outside of the bottle.

Figure 15C:
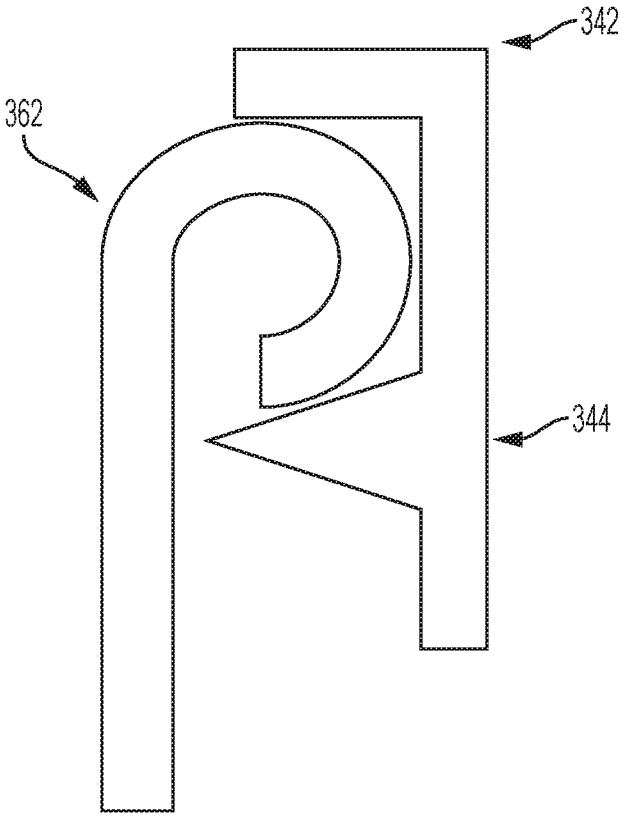
FIG. 15C shows a close-up view of a terminated and rolled locking chime, according to an embodiment of the invention.

FIG. 15C shows a close-up side profile of a neck locking chime 362 interfacing with the insert 340. The metal at neck locking chime 362 can be terminated and rolled rather than terminated and bent as shown in FIG. 15B. The surface to surface contact interface of the bottle neck seating collar flange 342 can be mated to the apex, or carry over extending past the apex. Both are acceptable. As the bottle neck seating collar flange 342 functionally serves to prevent the insert from pushing-in to the bottle, so long as the insert is physically barred from pushing in, the bottle neck seating collar flange 342 may mate to the apex or extend past the apex of neck locking chime 362.

Embodiment One "Standard Spill Inhibitor" represents a novel approach to spill inhibition effects on "Smooth Neck" bottle types, while the derivative "Embodiment Two" represents a similar novel approach to accomplishing the same spill inhibitory effects on "Internally Terraced Bottle Neck" bottle types.

While various exemplary embodiments have been described above, it should be understood that they have been presented by way of example only, and not limitation. Thus, the breadth and scope of the present disclosure should not be limited by any of the above-described exemplary embodiments.

We claim:

1. A bottle neck insert comprising:

a cylindrical body having a first end and a second end, the cylindrical body having a plurality of rings;

a flange provided at the first end, the flange protruding outwardly from the cylindrical body in a radial direction of the cylindrical body;

a valve section at the second end, the valve section having at least one slit, wherein the flange is configured to seat the insert onto a neck of a bottle and the valve section is configured to allow a pipette to pass through, and wherein the plurality of rings comprises a cylindrical housing having a mated collar-locking ring, a stability ring, and a thread stop sealing ring.

2. The bottle neck insert of claim 1, wherein the cylindrical body, the flange and the valve section are a single piece of continuous material that is composed of silicone.

3. The bottle neck insert of claim 1, wherein the plurality of rings are seal rings.

4. The bottle neck insert of claim 3, wherein the plurality of seal rings are configured to generate negative pressure against a smooth surface of the neck of the bottle.

5. The bottle neck insert of claim 4, wherein the plurality of seal rings are configured to generate negative pressure against the smooth surface of the neck of the bottle to lock the insert into a position during normal use.

6. The bottle neck insert of claim 3, wherein the plurality of seal rings are configured to generate negative pressure against an interior smooth surface of a neck of a Boston round bottle.

7. The insert of claim 6, wherein the plurality of seal rings outline at least one microchannel on an exterior surface of the cylindrical body where the negative pressure is configured to be generated.

8. The insert of claim 1, further comprising a bottle neck seating collar flange at a top section of the cylindrical housing.

9. The insert of claim 8, wherein the mated collar-locking ring is disposed at the top section of the cylindrical housing.

10. The insert of claim 8, wherein the mated collar-locking ring and the bottle neck seating collar flange are configured to lock a bottle lock chime of a bottle in between the mated collar-locking ring and the bottle neck seating collar flange.

11. The insert of claim 10, wherein the bottle neck seating collar flange and mated collar-locking ring outline a circumferential cavity that is configured to receive the bottle lock chime of the bottle.

12. The insert of claim 8, further comprising a valve segment that is disposed at a bottom section of the cylindrical housing, the bottom section being at an opposing end of the top section.

13. The insert of claim 12, wherein the valve segment comprises a plurality of valve slits.

14. The insert of claim 13, wherein the valve segment comprises six slits.

15. The insert of claim 1, wherein the cylindrical housing is configured to receive a pipette.

16. A bottle storage system, comprising:

a bottle having a neck with a smooth interior surface;

an insert according to claim 1 that is configured to fit inside the neck of the bottle; and a pipette assembly that is configured to proceed through the insert into the bottle.

* * * * *